US006675500B1

(12) United States Patent
Cadamuro

(10) Patent No.: US 6,675,500 B1
(45) Date of Patent: Jan. 13, 2004

(54) SHOCK-ABSORBING SOLE FOR FOOTWEAR, ESPECIALLY BUT NOT EXCLUSIVELY SPORTING FOOTWEAR

(76) Inventor: Vania Cadamuro, Via Villaraspa, 27, 36061 Bassano del Grappa (Vicenza) (IT)

( * ) Notice: Subject to any disclaimer, the term of this patent is extended or adjusted under 35 U.S.C. 154(b) by 0 days.

(21) Appl. No.: 10/283,821

(22) Filed: Oct. 29, 2002

(51) Int. Cl.[7] ..... A43B 13/28
(52) U.S. Cl. ..... 36/27; 36/28
(58) Field of Search ..... 36/27, 28, 7.8

(56) References Cited

U.S. PATENT DOCUMENTS 2,557,946 A * 6/1951 Crooker ..... 36/32 R
5,784,808 A * 7/1998 Hockerson ..... 36/28
2001/0007177 A1 * 7/2001 Brown et al. ..... 36/27

* cited by examiner

*Primary Examiner*—Ted Kavanaugh
(74) *Attorney, Agent, or Firm*—Steinberg & Raskin, P.C.; Grant E. Pollack

(57) ABSTRACT

A shock-absorbing sole for footwear comprising an assembly of shock-absorbing modules placed side-by-side and arranged in the longitudinal direction. Each module includes a wire-shaped element made of a selected material of relatively high strength and rigidity folded in such a way as to form a succession of upwardly-pointing loops lying in a plane that passes through the longitudinal axis of the module and at right angles to the outsole. The loops are inclined in the same general direction so that whenever the sole contacts the ground, each loop bends with a compliance that depends on its relative length and, thereafter, tends to regain its original condition by means of a relatively quick return with what is substantially a damped aperiodic harmonic motion. The greater or lesser compliance of the assembly depends also on the greater or lesser transverse density with which the modules are arranged.

13 Claims, 2 Drawing Sheets

SHOCK-ABSORBING SOLE FOR FOOTWEAR, ESPECIALLY BUT NOT EXCLUSIVELY SPORTING FOOTWEAR

FIELD OF THE INVENTION

The present invention relates generally to footwear and, more particularly, a new shock-absorbing sole, especially but not exclusively for sporting footwear.

BACKGROUND OF THE INVENTION

In most sports activities, the lower limbs of participants are frequently subjected to systematic and continuous impact stresses deriving from contact between their feet and the ground. These stresses are particularly intense in those sports that are practiced on artificial or other hard surfaces such as track and field events, basketball and volleyball, as well as tennis, futsal, football, soccer and numerous other minor sports. The problems that can result therefrom are especially widespread in competitive practice. Indeed, the intensity and frequency of foot activity are such that the athlete must always seek to protect himself from traumatic events and overuse which may, in turn, cause injuries or, in any case, inflammatory phenomena.

The difficulties associated with impact stresses sustained by the lower limbs are similarly experienced in amateur practice. For this reason, amateur athletes will also seek to minimize the possibility of suffering an injury, and to obtain maximum comfort from the footwear employed.

Various systems for increasing the shock-absorbing properties of the sole are known, all based on the use of inserts of appropriate visco-elastic behavior. These inserts are arranged in the midsole, i.e. the layer between the outsole and the insole, at least in the zone where the stresses are greatest, which normally corresponds to the bearing point of the heel. One of the most widely used systems, for example, employs one or more capsules made of soft material and filled with air.

However, when shock-absorbing systems have to be designed and realized, it is not easy to optimize the shock-absorbing capacities without this being accompanied by negative effects as far as support for the plantar arch is concerned. Furthermore, account has also to be taken of other important factors, among them durability in time, limitation of production costs, integration with the transpiration system of the sole and, not least, the aesthetic aspects.

OBJECTS AND SUMMARY OF THE INVENTION

An object of the present invention is to provide a novel shock-absorption system for soles of footwear such as sporting footwear, that will be fully satisfactory from all of the aforementioned points of view and, as a result, will provide superior and long-lasting absorption of impact forces, maintain adequate support of the foot, and limit production costs, all without hindering transpiration and negatively affecting the aesthetic appearance of the footwear.

The shock-absorbing sole in accordance with the invention comprises a substantially flat, a midsole connected to said insole, and an assembly of shock-absorbing modules placed side by side within said midsole and running along a longitudinal direction of the sole, each module consisting of a wire-shaped element made of a high-strength and rigid material, the element being folded in such a way as to form a succession of upward-pointing loops lying in the plane that passes through the longitudinal axis of the module and is at right angles to the outsole, all the loops being inclined in the same direction. Each of these loops, in response to an impact of the sole to the ground, will bend with a compliance which is a function of the length of the loop, and will then tend to return quickly to its original position, substantially according to a damped aperiodic harmonic motion. The greater or lesser compliance of the assembly will also depend on the greater or lesser transversal density with which the modules are arranged in the midsole.

BRIEF DESCRIPTION OF THE DRAWINGS

The characteristics and advantages of the shock-absorbing sole for footwear, especially but not exclusively sporting footwear, in accordance with the present invention will be brought out more clearly by the description about to be given of a particular embodiment thereof, which is to be considered solely as an example and not limitative in any way, said description making reference to the attached drawings in which.

DETAILED DESCRIPTION OF THE PREFERRED EMBODIMENTS

Figure 1:
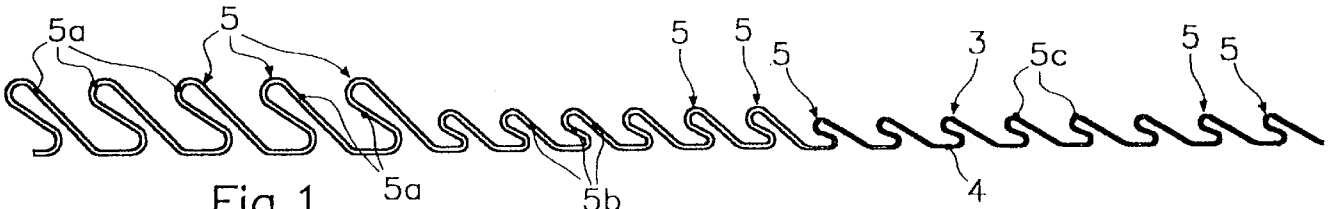
FIG. 1 shows a side elevation of a single shock-absorption module in accordance with the present invention.
Figure 2:
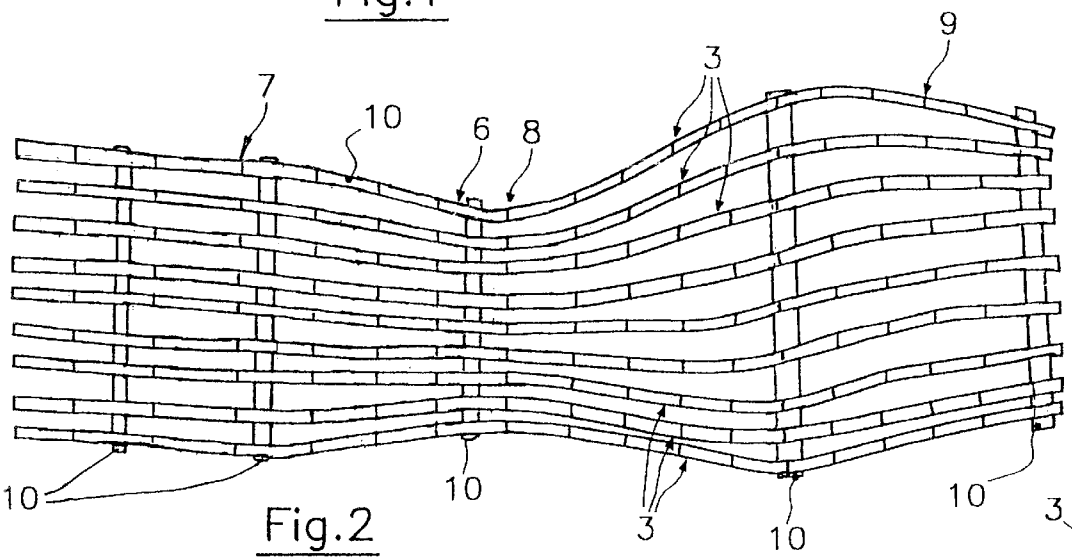
FIG. 2 shows a plan view of an assembly of shock-sorption modules like the one shown in FIG. 1.
Figure 3:
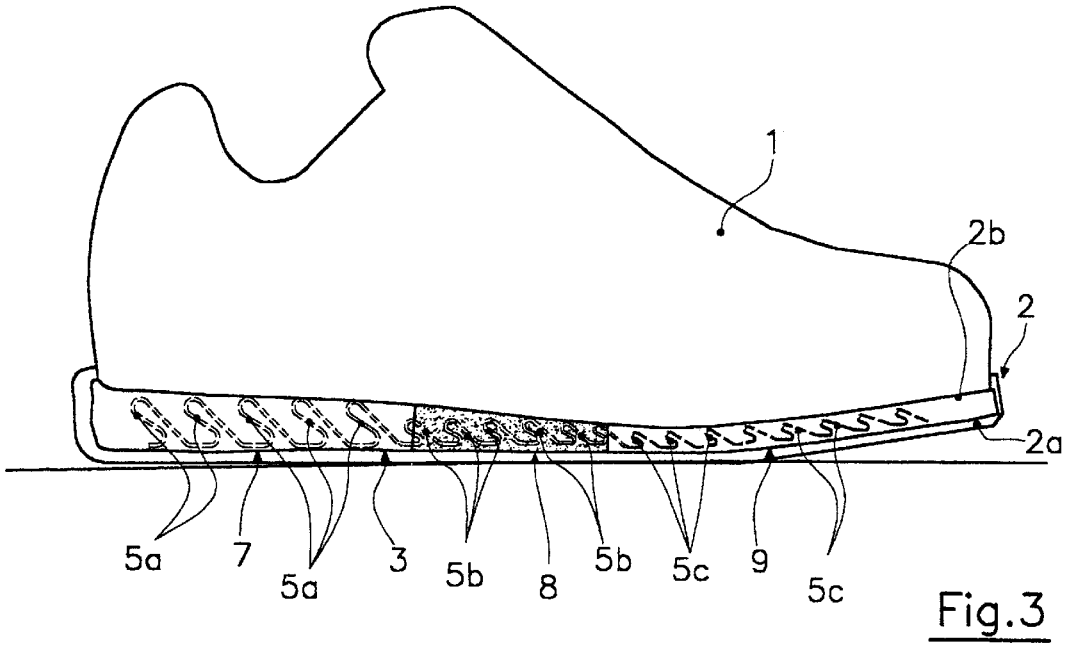
FIGS. 3 and 4 are layout patterns that illustrate the arrangement of the assembly of FIG. 2 in a footwear sole by means of, respectively, a side elevation and a plan view.
Figure 4:
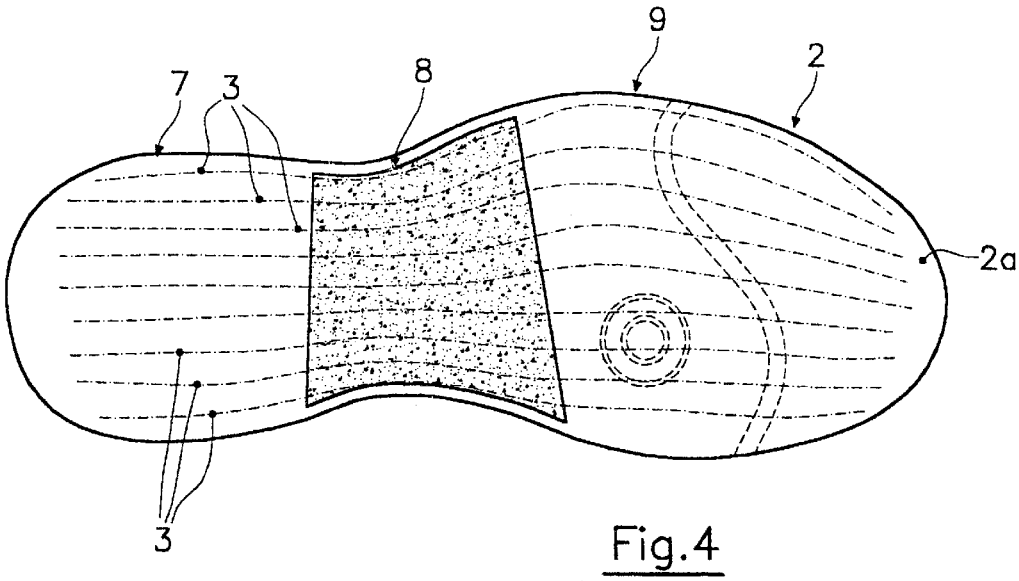

Referring to FIGS. 1 to 4, and particularly to FIGS. 3 and 4, in a sports shoe 1, here shown schematically, the sole 2 conventionally comprises an outsole 2*a* and a midsole 2*b*, realized in expanded polymer material with open cells. In accordance with the invention, within the midsole 2*b* there is arranged an assembly 6 of shock-absorption modules 3 each running along a longitudinal direction, i.e. the direction corresponding to the axis from the heel to the tip of the sole 2, and placed side by side.

As can be readily appreciated from FIG. 1, each shock-absorption module 3 consists of a wire-shaped element 4 folded in such a way as to form a succession of substantially U-shaped loops that point upwards, lying in the plane that passes through the longitudinal axis of the module and is at right angles to the outsole 2*a*, that is to say to the ground when the shoe is actually in use, i.e. with the sole 2 bearing against the ground. The loops are also uniformly inclined in said axis, with respect to the direction normal to the longitudinal axis of the module, preferably towards the rear part of the sole 2.

The loops 5 will bend when the sole strikes the ground, thus absorbing and dissipating a part of the impact energy. Thereafter they will tend to return quickly to their original position, performing what can substantially be described as a damped aperiodic harmonic motion. In order to achieve this result, the material used for making the wire-shaped element 4 must possess a particular rigidity.

A material that proves to be very suitable for this purpose is the acetalic resin known under the trademark DELRIN® by DUPONT. In fact, this material not only has a considerable tensile strength and a high rigidity and impact resistance, but is also characterized by excellent fatigue resistance, a factor that is obviously of great importance in view of the particular type of stress here considered. It is also very light and can be worked with relative ease. It is however possible to use with satisfactory results also other polymeric materials, and metallic materials, capable of assuring a behavior substantial equivalent to the one described hereinabove.

Although the loops 5 are of substantially similar form, they may differ in length, a feature that will render them more or less compliant in response to the stresses that derive from the impact with the ground when the shoe is in use. Furthermore, as can clearly be seen from FIGS. 2 and 4, since the width of the sole is appreciably less in the central part as compared with its width in the zone of the heel and the tip, the distance between the modules 3 as measured in the transverse direction will not remain constant. All other factors being equal, the overall compliance of the assembly 6 will therefore be greatest where the transverse density is least, i.e. in the vicinity of the heel and the tip. On the other hand, the assembly 6 will be more rigid as the transverse density becomes greater, so that maximum rigidity will be obtained in the central part. The overall effect that can be obtained by operating on the aforementioned two factors, i.e. length of the loops 5 within each individual module 3 and the transverse density of the modules 3 in the assembly 6 (and therefore in the sole 2), is brought out clearly by considering in particular FIGS. 3 and 4. In these figures one can note that in a rearward zone of the sole 2, indicated at the reference number 7, loops 5*a* are longer and the modules 3 are spaced further apart, so that a particularly good compliance is obtained in this zone and, with it, an excellent shock-absorption capacity.

In a central zone 8 of the sole 2, on the other hand, loops 5*b* are shorter and the modules 3 are less far apart, so that this zone is characterized by greater rigidity and therefore provides adequate support for the plantar arch. Lastly, in the tip zone 9 loops 5*c* are very short, but the modules are set well apart, with the effect of combining a good-shock-absorption capacity with the excellent flexibility that the sole should possess in this zone.

Other parameters that can be adjusted, both for regulating the compliance of the assembly 6—be it even with less appreciable effects than can be obtained by varying the aforementioned factors—and for adapting the assembly of modules to the size of the sole, are the thickness of the wire-shaped element 4 and the inclination of the loops 5 with respect to the axis of the relevant module 3. In the embodiment here illustrated, for example, the thickness of the wire-shaped element 4 is smaller and loops 5*c* are slightly more inclined in the tip portion 9 than in the central zone 7, this particularly in view of the fact that the thickness of the midsole 2*b* diminishes as the sole tip is approached.

In any case, the solution illustrated by the figures should be considered as a mere example, because the zones of greater or lesser shock-absorption capacity can also be differently distributed on the sole 2 to meet particular requirements, or in accordance with the type of shoe and especially the type of gymnastic or athletic activity for which the shoe is intended.

On the other hand, the assembly 6 does not necessarily have to extend over the entire longitudinal length of the sole 2. Indeed, even an assembly of reduced length and uniform shock-absorption capacity, i.e. with the modules 3 spaced a constant distance apart and with the loops 5 all of the same length, could be arranged in a part of the sole in which it is desired to optimize the shock-absorption capacity.

Preferably, as in the illustrated example, the wire-shaped element 4 will have a cross-section that is more or less flattened parallel to the plane of the outsole 2*a*. This will not only increase the load bearing capacity of the assembly 6, but will also facilitate its insertion in the midsole 2*b*. In this connection, it should be noted that various solutions could be adopted for linking the modules 3 to each other to form the assembly 6 and thus assure that they will effectively maintain the design spacing.

Figure 5B:
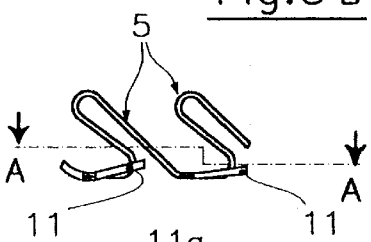
FIGS. 5A and 5B show, respectively, a side elevation and a plan view of a detail of the assembly shown in the previous figures, but with a linkage system between the modules in accordance with a particular embodiment of the invention, a part of the figure in either case being shown as a section.
Figure 5A:
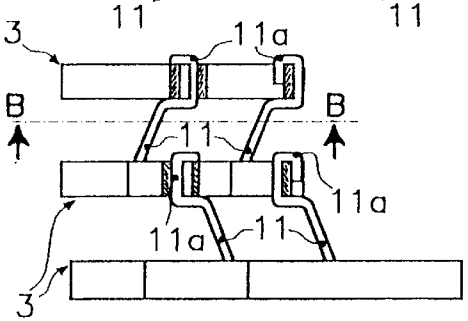

In accordance with a simpler solution, the modules 3 can be linked to each other and the outsole 2*a* by means of transverse stitchings 10, as schematically indicated in FIG. 2. Either as an alternative or in addition thereto, it is also possible to use rigid linkage systems as illustrated by FIGS. 5A and 5B, in the form—for example—of transverse arms 11 made of the same material as the wire-shaped elements 4. Arms 11 may extend diagonally between two adjacent modules, and engage with the straight parts of element 4 between the loops 5 via ends 11*a*, bent substantially in the form of a hook. This solution not only guarantees a completely safe and reliable linkage, but also renders the assembly 6 substantially self-supporting. This can be advantageously exploited to facilitate the handling of the assembly 6 and thus to render easier its insertion in the midsole 2*b* during the production process. Arms may as well be made integral to the modules 3.

The sole in accordance with the invention therefore fully attains the stated object. Indeed, it obtains a shock-absorption capacity adequate for any requirements associated with practical sporting use by either amateurs or professionals without in any way penalizing the support provided for the plantar arch. And it does so with a simple and light structure that remains reliable in time and, given the ease with which it can be incorporated in the sole, is also relatively cheap as far as production costs are concerned.

Furthermore, it does not obstruct transpiration through the sole; rather, the bending movements of the loops 5 can assist the conveyance of air in the direction normal to the outsole 2*a*. Lastly, the assembly 6 does not involve any parts that remain in view and can therefore be perfectly integrated with the aesthetics of the shoe. Not least thanks to this fact, the shock-absorbing sole in accordance with the invention can be advantageously used also in normal walking shoes.

Various modifications and alterations to the present invention may be appreciated based on a review of this disclosure. These changes and additions are intended to be within the scope and spirit of the invention as defined by the following claims.

What is claimed is:

1. A shock-absorbing sole comprising a substantially flat outsole, a midsole connected to said outsole, and an assembly of shock-absorbing modules placed side-by-side within said midsole and arranged in a longitudinal direction, each module including a wire-shaped element made of a relatively high-strength and rigid material, the element being folded in such a way as to form a succession of upwardly-pointing loops lying in a plane that passes through the longitudinal axis of the module and at right angles to the outsole, the loops being inclined in the same general direction, whereby each of said loops, in response to contact between the sole and the ground, bends with a compliance which is a function of the length of the loop, and, thereafter, tends to return relatively quickly to its original position, substantially according to a damped aperiodic harmonic motion, the greater or lesser compliance of the assembly also depending on the greater or lesser transverse density with which the modules are arranged in the midsole.

2. The sole set forth in claim 1, wherein said loops are inclined towards the rear pat of the sole.

3. The sole set forth in claim 1, wherein the distance between said modules is generally least in a central portion of the sole so as to yield properties of generally lesser compliance, and, thereafter, gradually increase toward both the rear portion and the front portion of the sole, so as to yield properties of relatively greater compliance.

4. The sole set forth in claim 1, wherein in each module, loops of relatively greater length are formed in a rearward zone of the sole so as to yield properties of generally greater compliance.

5. The sole set forth in claim 1, wherein the inclination of said loops varies generally along the length of the corresponding module.

6. The sole set forth in claim 1, wherein the thickness of said wire-shaped element varies generally along the length of the corresponding module.

7. The sole set forth in claim 1, wherein said wire-shaped element has a generally flattened cross-section.

8. The sole set forth in claim 1, wherein said modules are linked to each other by means of a number of generally transverse stitches.

9. The sole set forth in claim 1, wherein said modules are linked to each other by means of relatively rigid arms that extend generally between adjacent modules and comprise generally hook-shaped ends for engaging said wire-shaped elements.

10. The sole set forth in claim 1, wherein said modules are linked to each other by means of relatively rigid arms that extend generally between adjacent modules, said arms being integral with said wire-shaped elements.

11. The sole set forth in claim 1, wherein said material of said modules is a selected acetalic resin.

12. A shoe including a shock-absorbing sole which comprises a substantially flat outsole, a midsole connected to said outsole, and an assembly of shock-absorbing modules placed side-by-side within said midsole and arranged in a longitudinal direction, each module including a wire-shaped element made of a relatively high-strength and rigid material, the element being folded in such a way as to form a succession of upwardly-pointing loops lying in a plane that passes through the longitudinal axis of the module and at right angles to the outsole, the loops being inclined in the same general direction, whereby each of said loops, in response to contact between the sole and the ground, bends with a compliance which is a function of the length of the loop, and, thereafter, tends to return relatively quickly to its original position, substantially according to a damped aperiodic harmonic motion, the greater or lesser compliance of the assembly also depending on the greater or lesser transverse density with which the modules are arranged in the midsole.

13. A generally flat shock-absorption assembly for a sole of footwear, the assembly comprising a plurality of modules arranged side-by-side, each module including a wire-shaped element made of a relatively high-strength and rigid material, the element being folded in such a way as to form a succession of loops lying in a plane that passes through the longitudinal axis of the module and at right angles to the assembly, the loops being inclined in the same general direction, whereby each of said loops, in response to contact between the sole and the ground, bends with a compliance which is a function of the length of the loop, and, thereafter, tends to return relatively quickly to its original position, substantially according to a damped aperiodic harmonic motion, the greater or lesser compliance of the assembly also depending on the greater or lesser transverse density with which the modules are arranged.

* * * * *